US005105562A

United States Patent [19]

Hella et al.

[11] Patent Number: 5,105,562

[45] Date of Patent: Apr. 21, 1992

[54] WEB DRYER APPARATUS HAVING VENTILATING AND IMPINGEMENT AIR BAR ASSEMBLIES

[75] Inventors: Terry A. Hella, DePere; Carl L. Buchanan, Green Bay, both of Wis.

[73] Assignee: Advance Systems, Inc., Green Bay, Wis.

[21] Appl. No.: 634,030

[22] Filed: Dec. 26, 1990

[51] Int. Cl.[5] ..... F26B 13/00

[52] U.S. Cl. ..... 34/156; 34/160

[58] Field of Search ..... 34/155, 156, 160, 23; 226/97

[56] References Cited

U.S. PATENT DOCUMENTS

| | | | |
|---|---|---|---|
| 3,982,328 | 9/1976 | Gustafsson et al. | 34/156 |
| 4,058,244 | 11/1977 | Vits | 34/156 |
| 4,137,644 | 2/1979 | Karlsson | 34/156 |
| 4,274,210 | 6/1981 | Stengard | 34/156 |
| 4,292,745 | 10/1981 | Caratsch | 34/156 |
| 4,472,888 | 9/1984 | Spiller | 34/160 |
| 4,601,116 | 7/1986 | Krimsky | 34/156 |
| 4,698,914 | 10/1987 | Shu et al. | 34/23 |
| 4,787,547 | 11/1988 | Hella et al. | 34/156 |
| 4,833,794 | 5/1989 | Stibbe et al. | 34/156 |
| 4,901,449 | 2/1990 | Wimberger | 34/156 |

*Primary Examiner*—Henry A. Bennet
*Assistant Examiner*—Denise L. Gromada
*Attorney, Agent, or Firm*—Nilles & Nilles

[57] ABSTRACT

A ventilating and impingement air bar assembly for floatingly suspending a running web and comprising a direct impingement air bar for directing air directly against the coated side of the running web, a dilution air bar mounted along each side of the impingement air bar and in parallelism therewith. The dilution air bars have an air nozzle slot directed generally parallel to and along the web and in a direction away from the direct impingement air bar. The dilution air bars also have a coanda corner over which the air from the slot is directed away from the web. An air supply is provided for supplying air selectively to the impingement air bar or to the dilution air bars.

6 Claims, 7 Drawing Sheets

A
B
B
10
10
12
14
16
17
17
20
26
28
28
28
40
42
53
56
56
58
58
W

WEB DRYER APPARATUS HAVING VENTILATING AND IMPINGEMENT AIR BAR ASSEMBLIES

BACKGROUND OF THE INVENTION

1. Field of the Invention

The invention relates generally to air bars for floatingly guiding a running film or paper web of indeterminate length as it moves through an elongated housing of a dryer.

2. Background Information

Air bars utilized in web drying equipment of the type to which the present invention pertains are shown generally in U.S. Pat. No. 4,787,547, issued Nov. 29, 1988 to Hella et al; U.S. Pat. No. 4,944,098, issued July 31, 1990 to Hella et al; and U.S. Pat. No. 4,833,794, issued May 30. 1989 to Stibbe et al. The air bars shown in those prior art patents are located along each side of the running web in spaced apart relationship to one another, the bars on one side of the web being arranged alternately across from those bars on the other side of the web, thereby causing the web to move in the generally sine wave pattern through the housing in the known manner. The air bars shown in the above patents or in other prior art patents may cause the air being discharged through the bars to impinge directly on the web, thereby effecting drying thereof. Usually these webs are printed or coated on both sides and therefore the web must be floatingly suspended without touching the air bars from the time they enter the drying housing to the time of their discharge from the housing.

SUMMARY OF THE INVENTION

The present air bar finds particular utility for those situations where the coatings are quite fluid and easily disturbed by direct air impingement. Generally the solvents used evaporate so easily that the amount of air that impinges on the web and causes the evaporation is not enough to provide adequate dilution and maintain an explosion safe mixture. The non-impinging portion of the present air bar provides the extra air necessary for safe ventilation and operation without affecting the coated surface.

The present invention provides web drying apparatus of the type having an elongated housing through which a printed or coated web of indeterminate length is floatingly suspended as it moves through the housing and its printing or coating is dried. A series of elongated ventilating and impingement air bar assemblies are located transversely across the web and in spaced apart relation from one another and along one side of the web which is coated. The particular type of coating used with the present invention is of such a nature that in some instances the air must not impinge directly on the coating or the coating will be disturbed. On the other hand the air bar assemblies of the present invention include dilution or ventilating air bars which cause the heavy solvent laden air on the coated side of the web to be diluted, that is, the evaporated solvent is diluted by these dilution air bars. Thus these dilution air bars provide adequate ventilation and evaporate the amount of solvent being laid down along the web. In this manner the extra ventilation close to the surface of the web is used to dilute the evaporated solvent and acts to dry the web without disturbing the coated surface. These ventilating and impingement air bar assemblies also include a central direct impingement air bar which discharges air directly against the coated web surface when that is, under some circumstances, deemed to be desirable. The invention furthermore contemplates that the centrally located impingement air bar of the assembly is fed from a source of air which is separate from that source which feeds the ventilating air bars. A ventilating air bar is located on each side of the direct impingement air bar and is arranged in parallelism therewith. Through a series of manual, remote manual, or remote automatic damper operators it is possible to have a combination of drying programs; that is, the direct impingement central nozzles may be used separately from the ventilation air bars on either side thereof, or the ventilation air bars have their own source of pressurized air and can be used separately from the direct impingement air bars.

The other side of the web, that is, the uncoated side of the web is floatingly suspended by conventional air bars or air foils such as those shown in the above mentioned prior art air bar patents.

Another aspect of the present invention relates to an air bar assembly which has a centrally located impingement air bar and has a ventilating air bar on either side thereof, the direct impingement air bar directs air directly against the coated side of a running web while the dilution air bars on either side have air nozzle slots which are directed parallel to and along the web and direct air away from the centrally located direct impingement air bar. The air from these dilution air bars is then caused to follow a Coanda corner away from the web, thus causing the air adjacent the web to be diluted and the solvent to be removed from adjacent the web.

The Coanda corner is formed by a smooth curve and air flowing along a preceding surface naturally follows the curved corner and makes a turn by following the contour of the corner. This Coanda phenomenon is described and shown in U.S. Pat. No. 3,549,047, issued Dec. 22, 1970, in connection with flotation of sheet materials and air bars generally used for floatingly suspending a moving a web.

The dilution bar configuration would be used with an easily displaced solvent based coating with a low viscosity and heavy coat weight (LBS/REAM).

The impingement bar would be used with higher viscosity coatings or solvent based coatings with higher percent solids. These normally can take a higher rate of drying without displacing the coating.

The combined direct impingement nozzle and dilution air bars have separate air supply ducts and can be easily switched by remote damper operators so that either the direct impingement nozzle is used, the dilution nozzles are used, or both may be used at the same time.

These and other objects and advantages of the present invention will occur hereinafter as this disclosure progresses.

DESCRIPTION OF A PREFERRED EMBODIMENT

Figure 1:
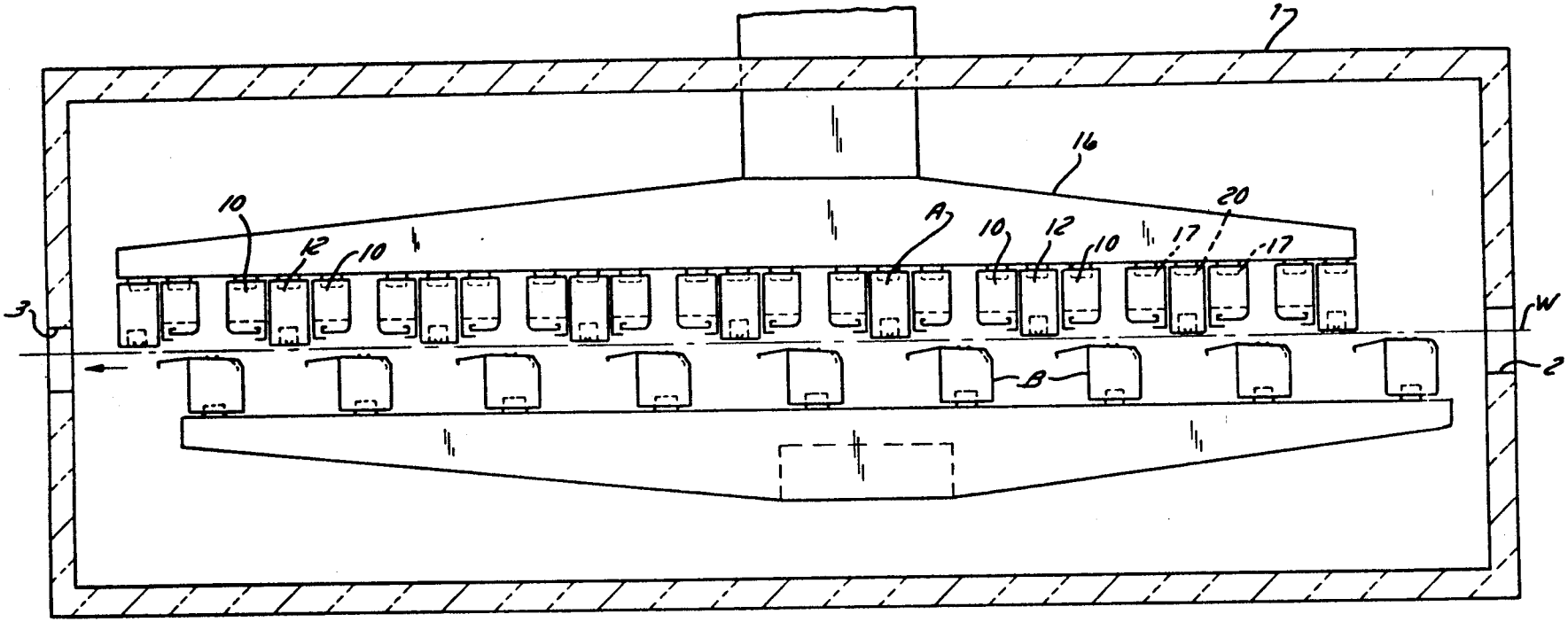
FIG. 1 is a vertical cross-sectional view through a dryer more or less schematic in form and showing the improved air bar assemblies located on the upper, coated side of the web as the latter moves through the housing.

The general environment of the present invention is shown and described in the before mentioned U.S. patents, the detailed construction and operation of apparatus of this type is fully described in those patents and it is believed sufficient to say for the purpose of this disclosure that the housing I shown in FIG. 1 is of the insulated type and has the horizontal opening 2 at its entry end and a discharge horizontal opening 3 at its discharge end, and through which openings the web W to be dried passes. The housing thus forms an insulated enclosure through which the web passes at several hundred feet per minute as its coating is being dried. The air bars floatingly suspend the web without contact as it passes through the housing 1.

In the present embodiment of the invention, the web is coated only on its upper side and is of such a nature that under some circumstances, direct impingement of air against the coated side by the air bars is not desirable. Therefore the present invention provides a series of dilution air bars 10 mounted adjacent to and one on each side of a direct impingement air bar 12. Thus a central, direct impingement air bar 12 together with a dilution air bar 10 mounted closely adjacent either of its sides constitutes a ventilating and impingement air bar assembly A for treating the web along its upper coated side.

Figure 2:
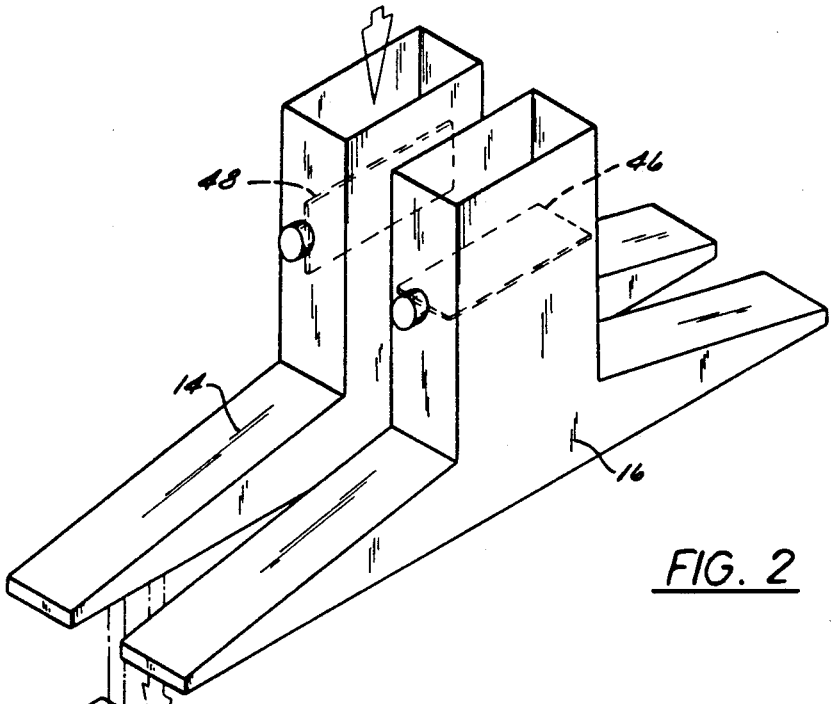
FIG. 2 is a partial, perspective, exploded view of the air supply ducts and showing one of the ducts as indicated to be supplying air to the ventilating air bars.
Figure 3:
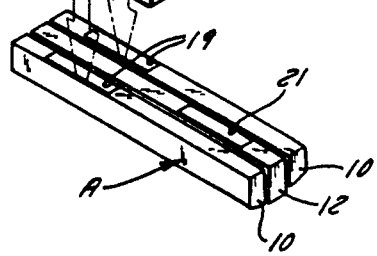
FIG. 3 is a view similar to FIG. 2 but showing the other air duct supplying pressurized air to the central, direct impingement air bar.
Figure 3:
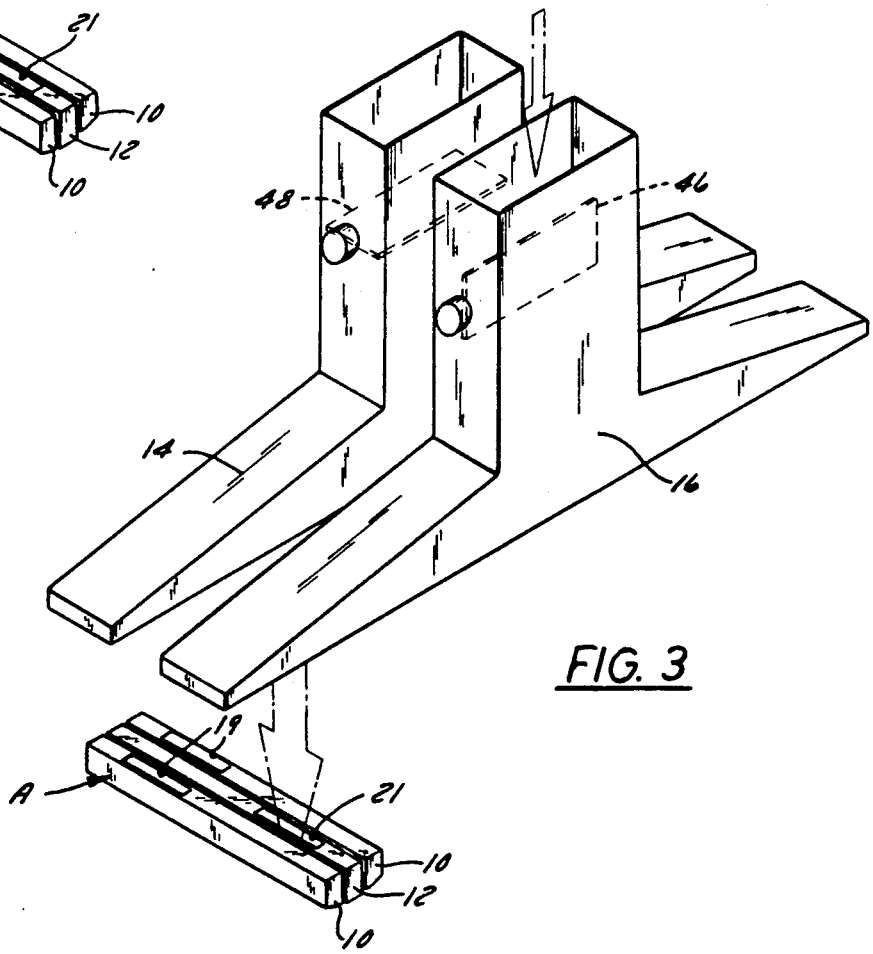

The dilution air bars 10 receive pressurized air from their header duct 14 as shown in FIGS. 2 and 3. The center, direct impingement air bar 12 receives its pressurized air from the header duct 16. Air is conducted from the duct 14 and into the air bars 10 by means of the necks 17 (FIG. 6) which extend through the sealing means 18 held in the rectangular opening 19 in the inner side of the air bar 10. Rectangular opening 19 is formed as an inwardly facing channel. This connecting construction between the air ducts and the individual air bars is fully shown and described in the said U.S. Pat. No. 4,787,547.

Figure 7:
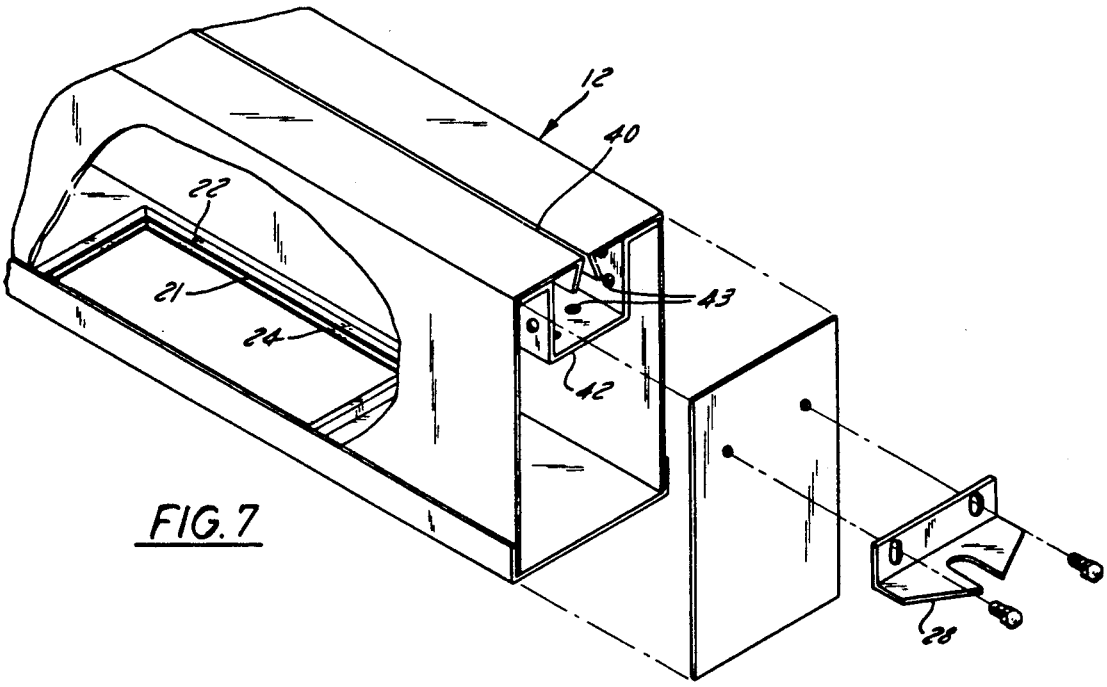
FIG. 7 is a fragmentary, perspective, exploded air view of a portion of the direct impingement nozzle shown in FIG. 1, but on an enlarged scale, and with certain parts shown as broken away for clarity in the drawings.
Figure 8:
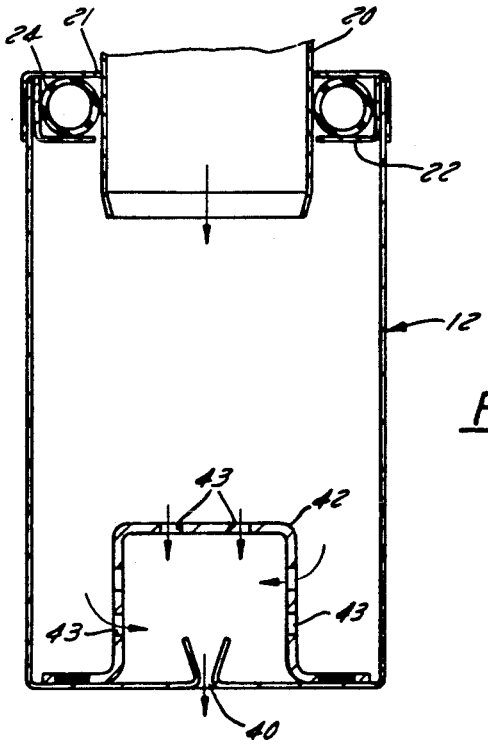
FIG. 8 is a vertical cross-sectional view through the central, direct impingement air bar shown in FIG. 1, but on an enlarged scale.

As shown in FIG. 8, a neck 20 similarly connects the duct 16 with the interior of the direct impingement air bars 12. The rectangular opening 21 in the bottom of the air bars 12 is also shown in FIG. 7 and is also formed as an inwardly facing channel 22 in which the flexible sealing member 24 is located.

Figure 5:
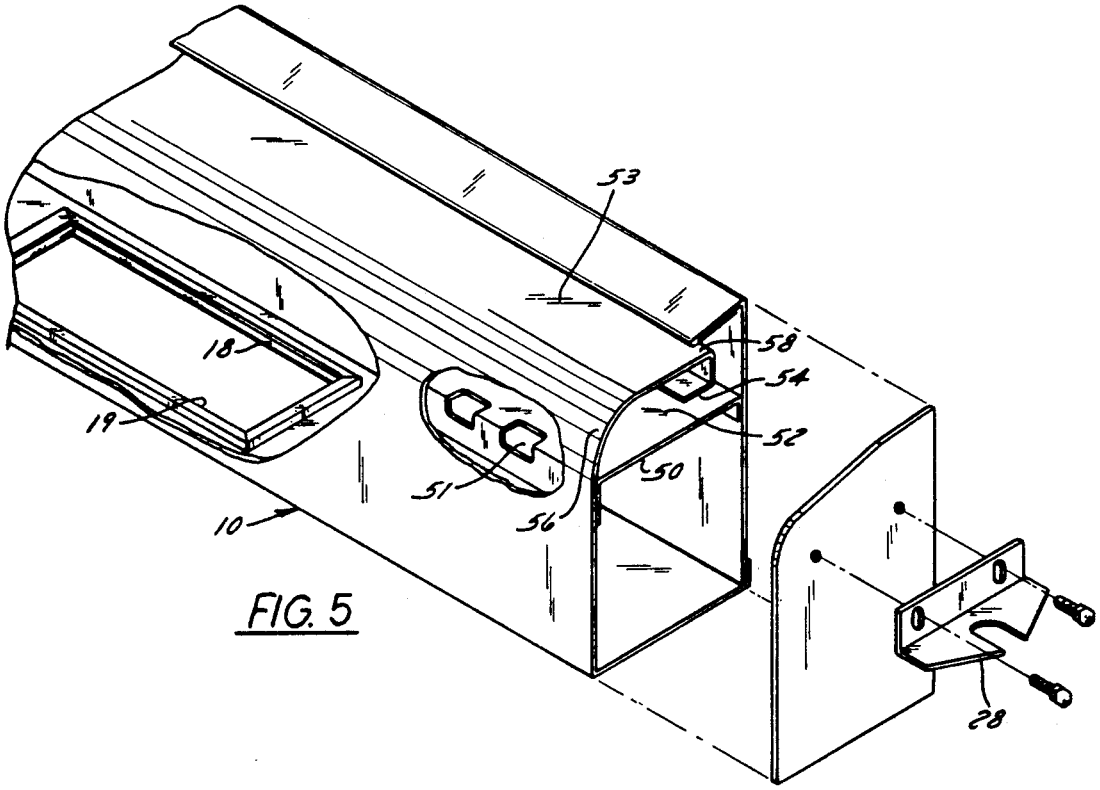
FIG. 5 is a perspective view of the end portion of one of the ventilating air bars, on an enlarged scale, and showing certain parts as broken away or exploded for clarity in the drawings.
Figure 9:
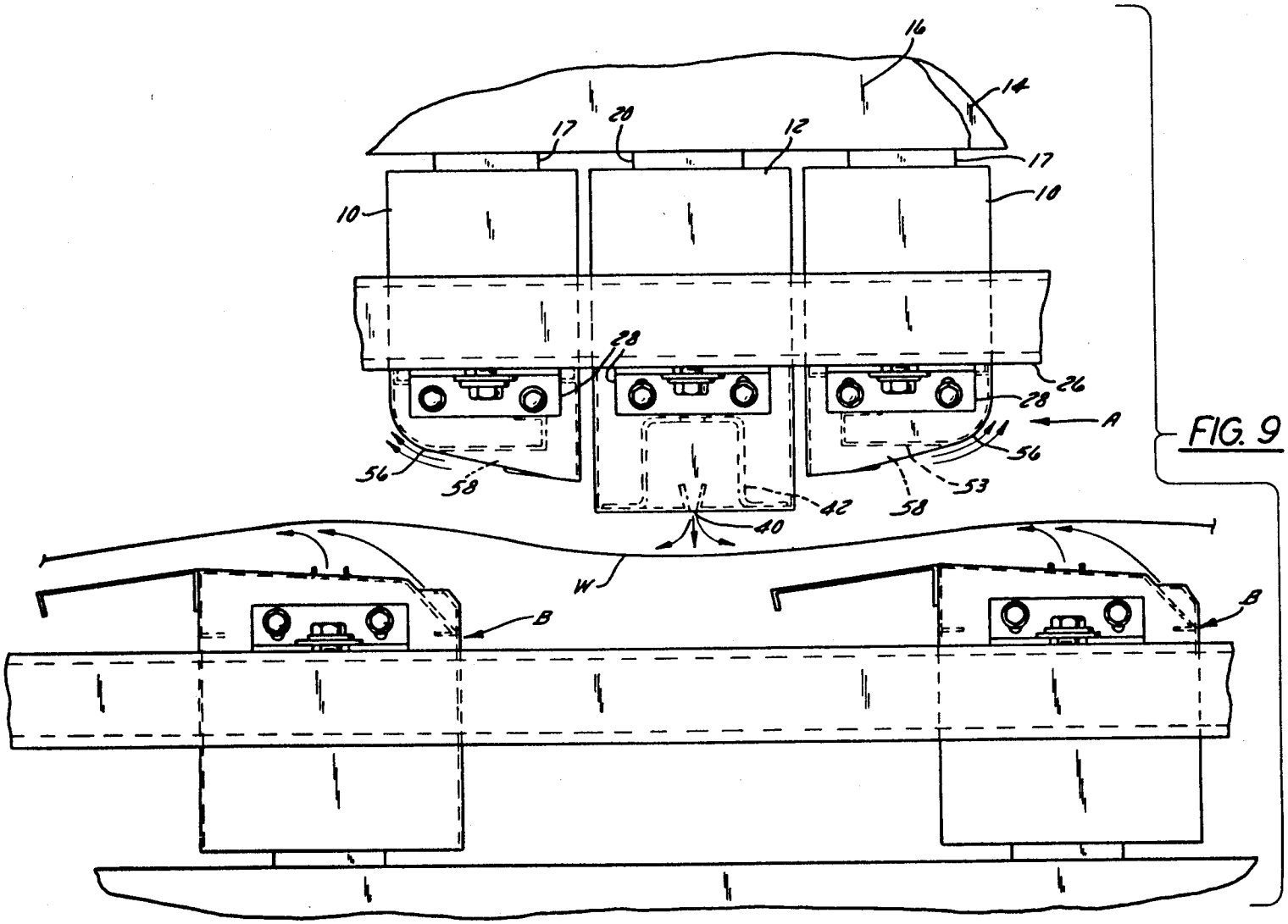
FIG. 9 is a elevational view of a portion of the FIG. 1 showing, but on an enlarged scale, and showing the web passing between the upper air bar assemblies and the lower floater air bars.
Figure 10:
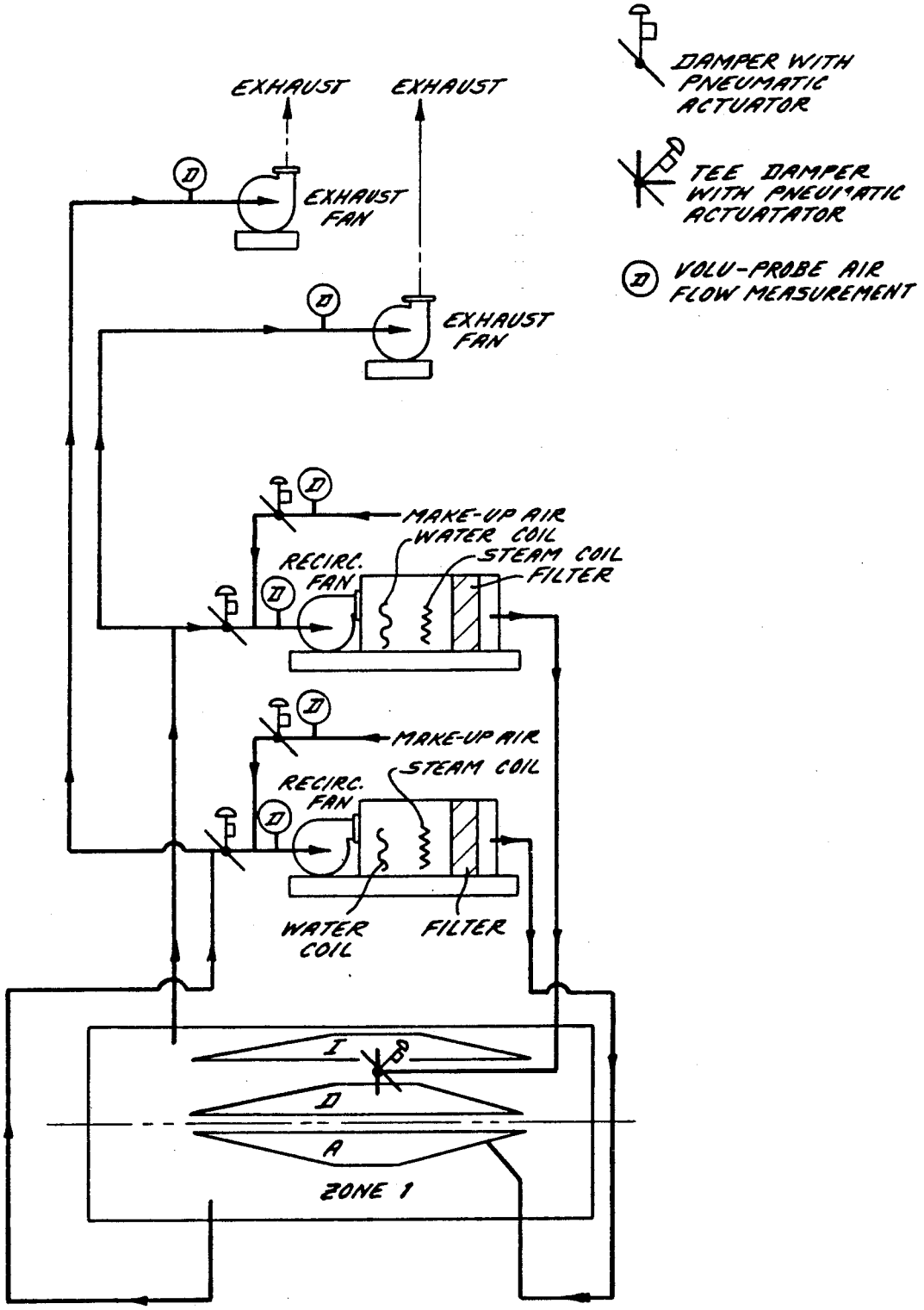
FIG. 10 is a schematic diagram of the process and instrumentation of the process.

As indicated in FIGS. 5, 7 and 9, the air bars are rigidly fixed to housing frame members 26 (FIG. 9) by means of angled brackets 28 which are rigidly fixed by suitable screws to the ends of the air bars. This air bar mounting construction and adjustment is also shown in said U.S. Pat. No. 4,787,547 and its further description is not deemed to be either necessary or desirable.

As shown in FIG. 1, a series of conventional air foil air bars B are located along the lower side of the web for floatingly suspending it. It will be noted that the upper air bar assemblies A are located along the direction of web movement and in spaced relationship with one another along the upper surface of the web. The lower air foil air bars B are also located in spaced relationship along the lower side of the web and furthermore in alternately spaced relationship with the upper air bars A. The alternate spacing of the upper and lower air bars acts to cause the web to move in a sine wave pattern (FIG. 9) through the dryer in a known manner and for the purposes set forth in the above mentioned prior art and others.

Referring in greater detail to the center, direct impingement air bars 12 (FIG. 8), they have been shown as having a central air discharge slot 40 extending transversely of the web and which direct the high velocity air from the interior of the bar 12 directly against the web. In passing from the interior of the bar 12, the high velocity air is first caused to pass through an internal centrally located U-shaped member 42. Member 42 has a plurality of apertures 43 along its length and through which the air passes before entering the discharge slot 40. The perforations 43 in the interior member 42 cause the air in the bar 12 to be more evenly distributed from the interior of the bar 12 to the discharge slot 40.

Figure 4:
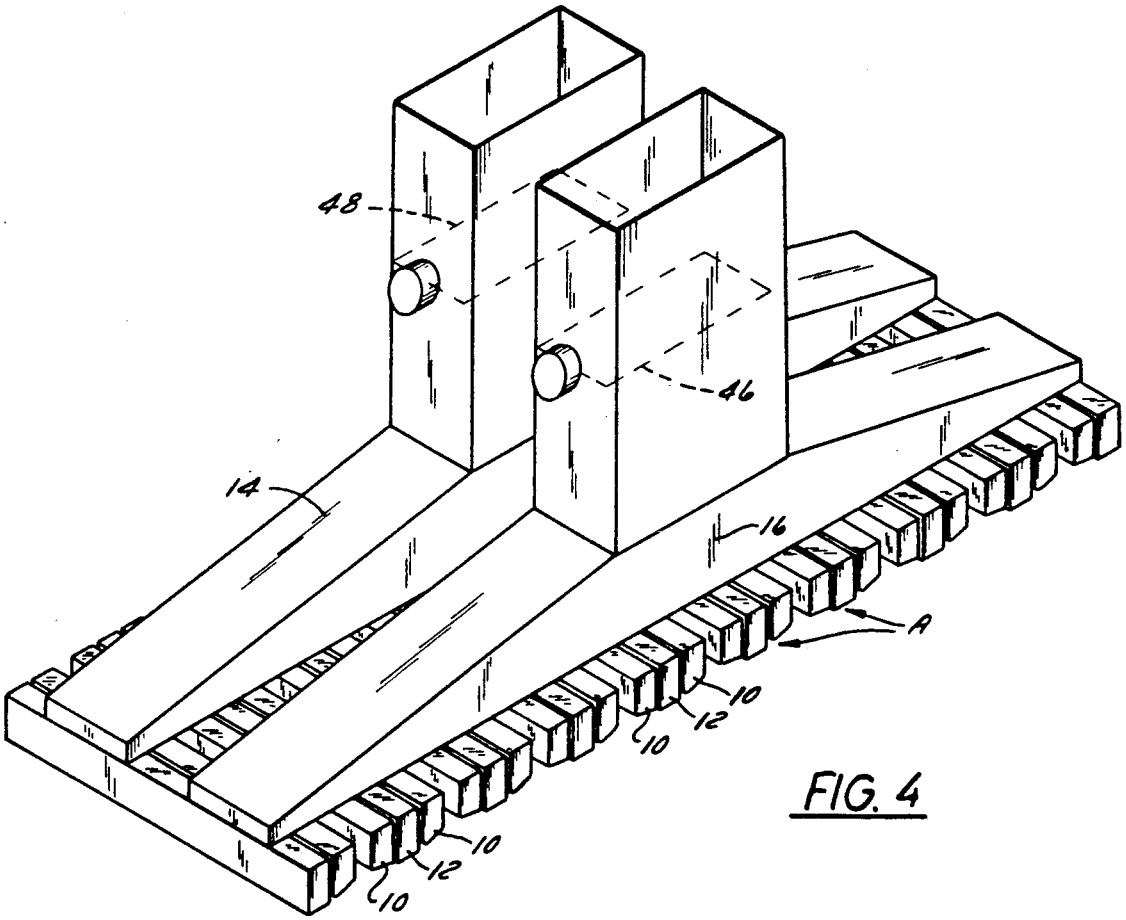
FIG. 4 is a perspective view of the air ducts assembled with their respective air bars.

The duct 16 (FIGS. 2, 3 and 4) has a damper 46 in its upper duct portion and this damper can be actuated to block air from passing into direct impingement bars 12 or to permit air to be fed to the air bars 12. In addition, the amount of air admitted to the interior of the air bars 12 can be regulated or varied. In some instances it is not desirable to have any direct impingement air acting on the coated surface of the web, and in that case the damper 46 would be closed.

Damper controls (not shown) for the damper may be actuators which are activated electrically or pneumatically, or be manual or automatic. Dampers could be activated by a LEL monitor to maintain 25 or 50 percent LEL mixtures, etc.

Figure 6:
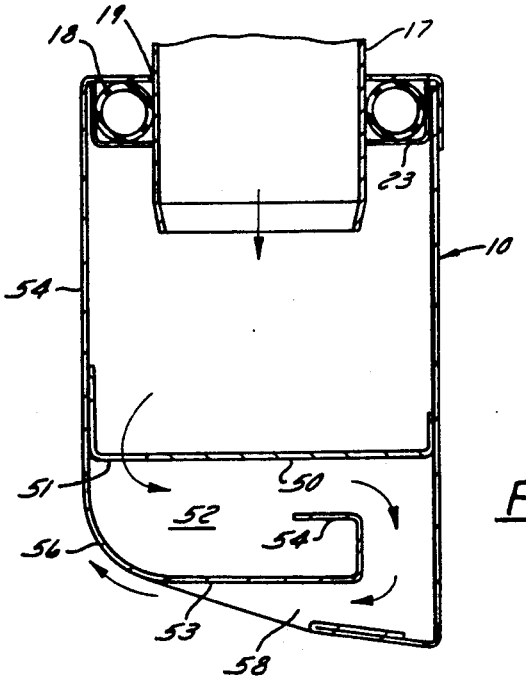
FIG. 6 is a cross-sectional view through one of the ventilating air bars, the view being substantially enlarged from the bars shown in FIG. 1.

Referring to the dilution air bars 10 and as particularly shown in FIG. 6, pressurized air is conducted from the duct 14 (FIG. 4) and via the neck 17 (FIG. 6) into the interior of the air bars 10. The upper portion of duct 14 (FIG. 4) also has a pivotal damper 48 which can be selectively adjusted to permit full flow of air into the interior of the air bars 10 (FIG. 6), to restrict any flow into the air bars 10, or to permit a regulated amount into the interior of the air bar 10 The amount of air permitted into the dilution air bars depends on a number of factors such as, for example, the amount of solvent laden air that is required to be removed and the aggressiveness of such air removal action that is required.

Referring to the internal construction of the dilution air bars 10, as shown in FIG. 6, an internal plate 50 is secured (as by welding) across the interior of the air bar and it has a series of openings 51 (FIGS. 5 and 6) which permit the air from the duct 14 to enter into an outer portion or chamber 52 of the interior of the bar 10. A portion 53 of the bar 10 extends across the inner end of the bar 10 and has an inwardly turned return portion 54 forming in part of the chamber 52 at the outer end of the air bar 10. Portion 53, along with the side wall 54 of the bar, also defines a Coanda corner 56 as air discharging from bar 10, as will appear, passes over the corner 56 and closely follows its contour so as to be directed away from the web W. The air is discharged from the bar 10 via the opening 58 and takes the path shown by the curvilinear arrows in FIG. 6. This discharge opening 58 extends along the length of the air bar and is directed generally in the direction of web movement (or parallel to the web surface) as indicated in FIG. 9. After exiting from the discharge opening 58, the air closely follows the contour of the Coanda corner and is directed away from the web, as shown in FIG. 9. Thus the air emanating from the dilution nozzles 10 does not impinge directly on the web but instead more or less sweeps the solvent laden air adjacent the web away from the web and into area 60 between the air bar assemblies A (FIG. 1) where it is removed by the conventional exhaust blower (not shown). The path of the air as it leaves the dilution nozzles is shown generally by the curvilinear arrows in FIG. 9 also.

The openings 51 in the internal baffle plate 50 of the air bars 10 are for the purpose of minimizing undue turbulence in the air, creating even distribution, and acting to direct the air in a steady and smooth flow out of the discharge nozzle 58.

Under some circumstances it may be desirable to utilize only the dilution air bars 10 of the air bar assemblies A, and this can be accomplished by closing the damper 46 in the air supply duct 16 which feeds the direct impingement air bars 12.

Alternately, under some circumstances it may be desirable to utilize both types of bars 10 and 12 of the air bar assembly, that is, both the direct impingement and the dilution air bars.

The present invention thus provides web drying apparatus for treating a running web through an elongated dryer housing, which web, in the illustration shown, is coated only on its upper side. However, this apparatus could be used on webs with coatings on both sides. The apparatus has a series of the air bars A (FIG. 1) comprising the central, direct impingement air bar 12 and the two adjacent dilution air bars 10. Assemblies A are disposed at spaced apart locations along the upper side of the web length. The dilution air bars 10 are located along each side of the impingement air bar 12 and in parallelism therewith, and the dilution air bars 10 have their air nozzle slot 58 directed generally parallel to and along the web and in a direction away from the central, direct impingement air bar 12. These dilution air bars have a Coanda corner 56 over which the air from their discharge slot 58 passes so as to then be directed around the corner and away from the web. Thus the dilution air bars ventilate the air adjacent the web and evaporate and dilute the solvent in the air along the coated side of the web. The air from bars 10 act to sweep the air away from the web and dry the web without disturbing the coating thereon.

What is claimed is:

1. A ventilating and impingement air bar assembly for treating a running web which is coated on one side, said assembly comprising, an individual and elongated direct impingement air bar for directing air directly against said coated side of said running web, an individual and elongated dilution air bar mounted along each side of said impingement air bar but separated therefrom and in parallelism therewith, said dilution air bars being spaced from one another and from said direct impingement air bar, said dilution air bars having an air nozzle slot directed generally parallel to and along said web and in a direction away from said direct impingement air bar and also having a Coanda corner over which the air from said slot is directed away from said web, and air supply means for supplying air selectively and separately to said impingement air bar or to said dilution air bars.

2. A ventilating and impingement air bar assembly for treating a running web which is coated on one side, said assembly comprising, an individual and elongated direct impingement air bar for directing air directly against the coated side of said running web, an individual and elongated dilution air bar mounted along each side of said impingement air bar but separated therefrom and in parallelism therewith, said dilution air bars being spaced from one another and from said direct impingement air bar, said dilution air bars having an air nozzle slot directed generally parallel to and along said web and in a direction away from said direct impingement air bar, said dilution air bars also having a coanda corner over which the air from said slot passes so as to be then directed around said corner and away from said web, whereby the air from said dilution air bars ventilates the air and evaporates and dilutes solvent in the air along said coated side of said web and sweeps said air away from said web, and air supply duct means for supplying air selectively and separately to said impingement air bar or to said dilution air bars.

3. Web dryer apparatus of the type having an elongated housing through which a web of indeterminate length is coated on one side is floatingly suspended as it moves through the housing, a series of elongated ventilating and impingement air bar assemblies located transversely across said web and in spaced apart relation from one another and along the coated side of the web for directing air against the web for drying said web and also for ventilating solvent laden air along said coated side, said assemblies comprising, an individual and elongated direct impingement air bar for directing air directly against the coated side of said running web, a first source of pressurized air for said direct impingement air bar, an individual an d elongated dilution air bar mounted along each side of said impingement air bar but separated therefrom and in parallelism therewith, a second and separate source of pressurized air for said dilution air bars, said dilution air bars having an air nozzle slot directed generally parallel to and along said web and in a direction away from said direct impingement air bar, said dilution air bars also having a coanda corner over which the air from said slot passes so as to be then directed around said corner and away from said web, whereby the air from said dilution air bars ventilates the air and evaporates and dilutes the solvent in the air along said coated side of said web and sweeps said air away from said web and drys said web without disturbing the coating on said one side.

4. The apparatus set forth in claim 3 including air supply means for said first source of pressurized air and for supplying air to said impingement air bar, and second air supply means for said second source of pressurized air supplying air separately to said dilution air bars.

5. The apparatus set forth in claim 3 including air bar means along the other side of said web for floatingly supporting said web along said other side.

6. The apparatus set forth in claim 4 including adjustable air dampers for said air supply means for individually and separate adjusting the air delivered to said impingement air bars and to said dilution air bars.

* * * * *